United States Patent [19]

Duve

[11] Patent Number: 4,599,499

[45] Date of Patent: Jul. 8, 1986

[54] FAST IMPULSE TIMER DRIVE MECHANISM

[75] Inventor: John P. Duve, Brookfield, Ill.

[73] Assignee: Controls Company of America, Schiller Park, Ill.

[21] Appl. No.: 759,541

[22] Filed: Jul. 26, 1985

[51] Int. Cl.[4] ..... H01H 43/00

[52] U.S. Cl. ..... 200/35 R; 200/38 R; 200/153 PA; 74/436

[58] Field of Search ..... 200/35 R, 38 R, 38 B, 200/38 BA, 38 C, 38 CA, 153 PA; 74/116, 436, 568 T

[56] References Cited

U.S. PATENT DOCUMENTS

| | | | |
|---|---|---|---|
| 2,582,285 | 1/1952 | Schellens | 200/38 D |
| 3,066,208 | 11/1962 | Fannon, Jr. et al. | 74/436 X |
| 4,311,059 | 1/1982 | Wagle | 74/116 |
| 4,467,664 | 8/1984 | Willigman et al. | 74/116 |
| 4,500,212 | 2/1985 | Wojtanek | 200/38 B X |
| 4,536,626 | 8/1985 | Wojtanek | 200/38 B X |

*Primary Examiner*—J. R. Scott

*Attorney, Agent, or Firm*—David L. Davis; Robert E. Smith; Edward L. Bell

[57] ABSTRACT

A drive mechanism for a program timer of the type having a rotating member advanced in a step-by-step manner by a drive pawl includes a drive cam having a camming surface defining the drive stroke of the drive pawl. In order to shorten the switching time, the drive cam is intermittently rotated by an angle sufficient to drive the pawl to advance the rotating member during a single intermittent movement of the drive cam. Sub-interval switching is accomplished by the cooperation between a pivotable sub-interval switching lever and a sub-interval camming surface on the drive cam, with the lever actuated by the camming surface to control the movement of a sub-interval switch blade.

7 Claims, 5 Drawing Figures

FAST IMPULSE TIMER DRIVE MECHANISM

BACKGROUND OF THE INVENTION

This invention relates to timers of the type advanced in a step-by-step manner by a drive mechanism and, more particularly, to the drive mechanism itself.

When designing a drive mechanism for a switching device in a program timer, a number of criteria must be taken into consideration. For example, it is desirable to advance the switching device at a relatively rapid rate for fast switching action. A common prior design is an indexing mechanism which drives the switching device in a step-by-step mannner and includes a ratchet track on the switching device and a drive pawl which cooperates with the ratchet track to index the switching device. A continuously rotating cam moves the drive pawl in a reverse direction against the action of a spring. When the camming surface drops off, the spring quickly moves the drive pawl in the forward direction to index the switching device. An improved mechanism is disclosed in U.S. patent application Ser. No. 616,092, filed June 1, 1984, now U.S. Pat. No. 4,536,626, wherein a drive pawl has a cam follower trapped between two camming surfaces of a drive cam. One of the camming surfaces defines the drive stroke of the drive pawl and the other camming surface defines the return stroke of the drive pawl. With the disclosed design, the switching time is about one fifth of the time between advances of the switching device. The switching time cannot be reduced substantially below this fraction because there is a limit to the slope of the camming surface defining the drive stroke.

It is therefore an object of this invention to provide a drive mechanism for advancing the switching device in a program timer in a step-by-step manner wherein the drive movement profile of the drive pawl is tailored by means of a camming surface and wherein the effective slope of the camming surface is increased so that the switching time is reduced with respect to the time interval between advancements.

In certain applications of program timers, it is desirable to be able to provide sub-interval switching. It is therefore a further object of this invention to provide such sub-interval switching in a program timer having a drive mechanism as described above.

SUMMARY OF THE INVENTION

The foregoing and additional objects are attained in accordance with the principles of this invention in a program timer of the type having a continuously driven motor, a plurality of timing cams mounted on a rotating member and controlling the operation of switches in a predetermined program, a ratchet track on the rotating member, and a drive pawl operatively associated with the ratchet track and the motor for advancing the rotating member in a step-by-step manner by providing a rotatable drive cam having a camming surface thereon for defining the drive stroke of the drive pawl, the camming surface being included within a fixed angle of 360°/N around the axis of rotation of the drive cam, where N is an integer greater than 1, a cam follower on the drive pawl cooperating with the camming surface, and drive means coupled between the motor and the drive cam for intermittently rotating the drive cam by the fixed angle, the drive means and the drive cam being so synchronized that all of the camming surface engages the cam follower during a single intermittent movement of the drive cam.

BRIEF DESCRIPTION OF THE DRAWINGS

The foregoing will be more readily apparent upon reading the following description in conjunction with the drawings in which like elements in different figures thereof have the same reference character applied thereto and wherein.

DETAILED DESCRIPTION

Figure 1:
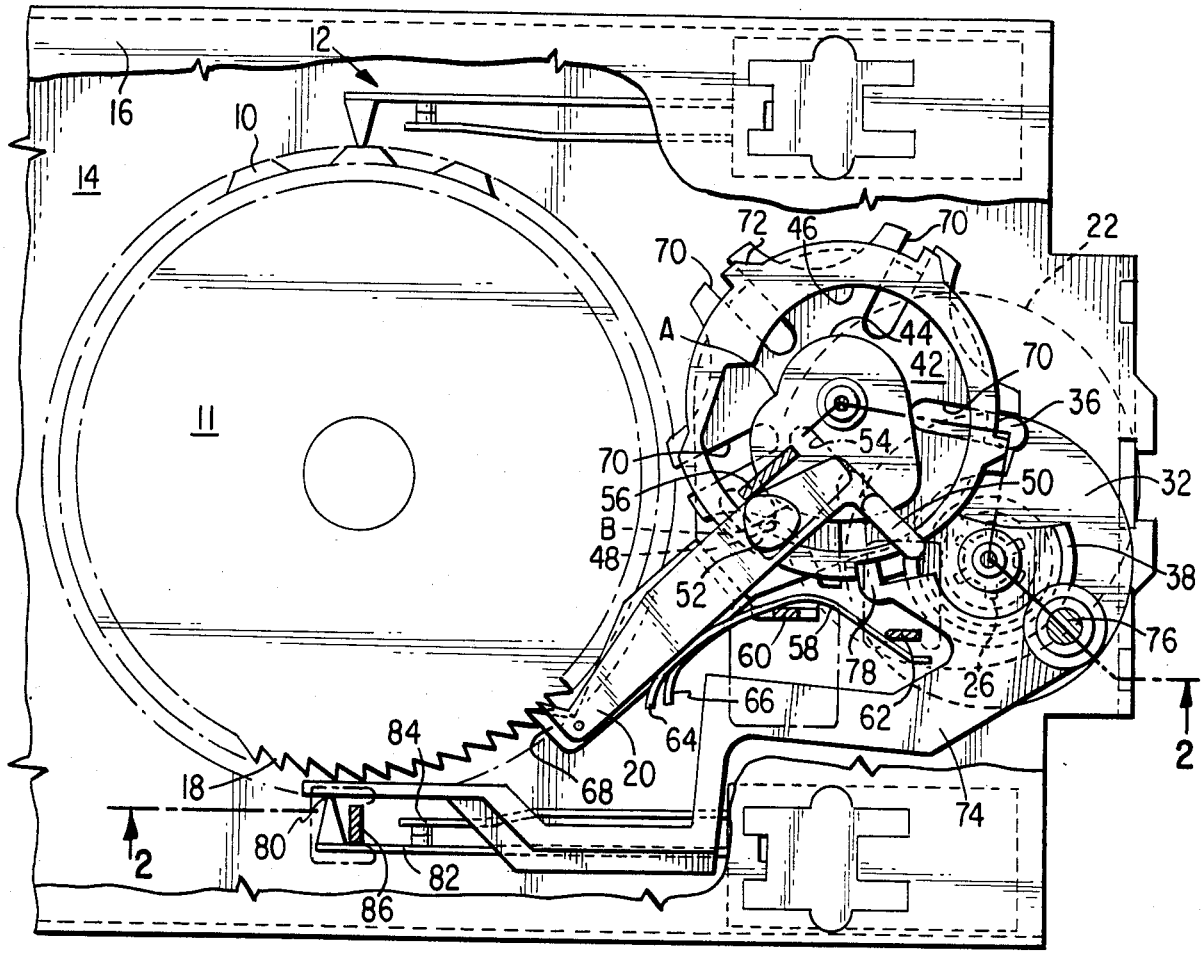
FIG. 1 is a plan view through the front plate of a program timer showing a drive mechanism constructed in accordance with this invention.
Figure 2:
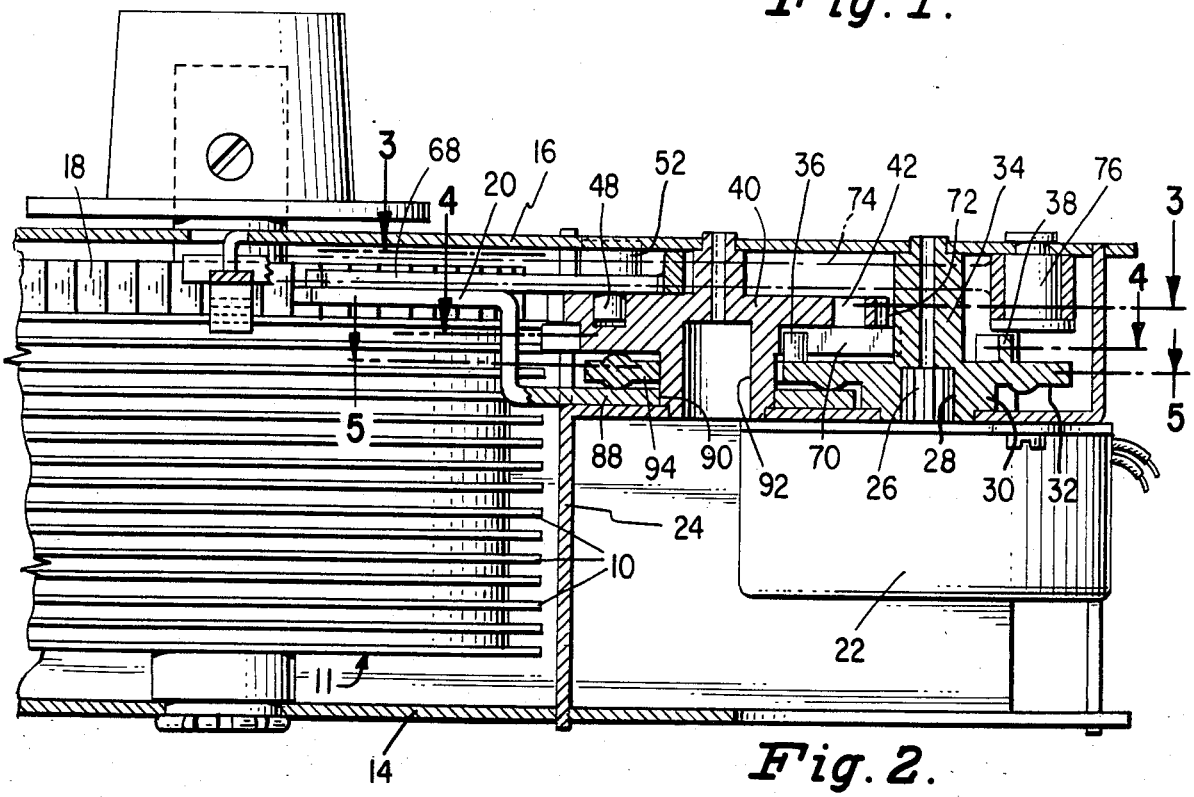
FIG. 2 is a cross sectional view taken substantially along the line 2—2 in FIG. 1 showing the pertinent features of the illustrated construction.

The drawings show the relevant portions of a program timer necessary for an understanding of the present invention. Thus, as is well known, the program timer includes a plurality of timing cams 10 located on a rotating member 11 for controlling the operation of switches 12 in a predetermined program. In particular, the rotating member 11 is a hollow cam drum, sometimes referred to as a monoblock, which is rotatably journaled between a rear plate 14 and a front plate 16. The details of the monoblock 11 with respect to the timing cams 10 and the switches 12 are well known in the art and form no part of the present invention.

The present invention is concerned with the mechanism for driving the monoblock 11. Accordingly, there is provided a ratchet track 18 on the monoblock 11. A drive pawl 20 is operatively associated with the ratchet track 18 to drive the monoblock 11 in a step-by-step manner, as will become clear from the following discussion.

The drive power source is a motor 22 mounted on a motor mounting plate 24 secured to the rear plate 14 and the front plate 16. As is conventional, the motor 22 is a reduction motor having an output shaft 26. The shaft 26 fits into an opening 28 provided therefor in a boss 30 formed on a Geneva drive wheel 32. The other side of the Geneva drive wheel 32 is formed with a stub shaft 34 which is journaled for rotation in a suitable opening provided in the front plate 16. Accordingly, the motor 22 rotates the Geneva drive wheel 32 in a counterclockwise direction, as viewed in FIG. 1.

Figure 3:
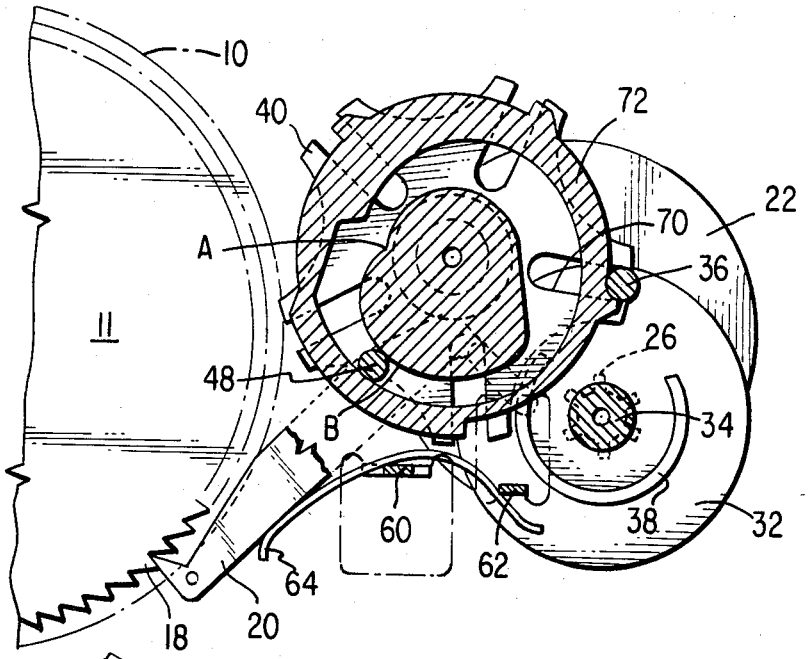
FIG. 3 is a cross sectional view taken along the line 3—3 in FIG. 2.
Figure 4:
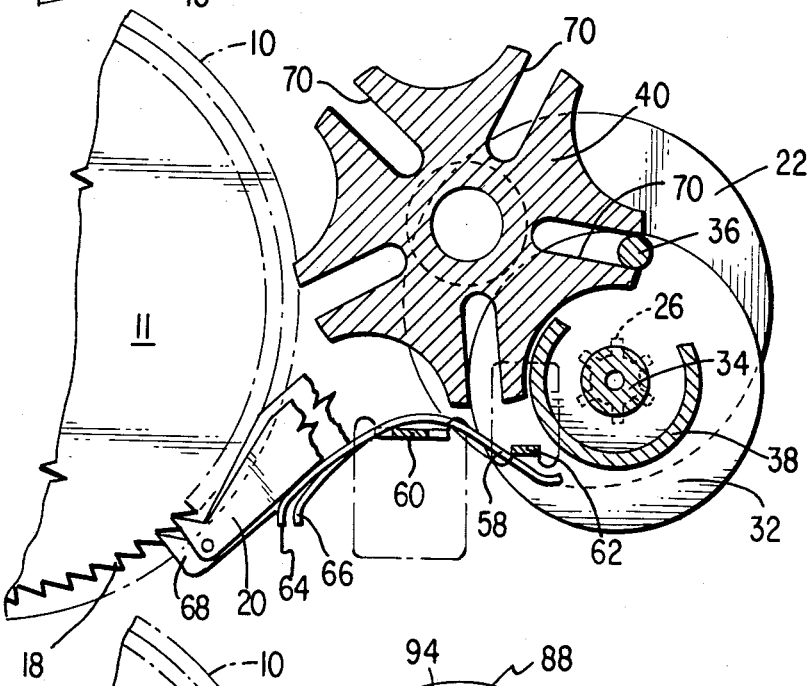
FIG. 4 is a cross sectional view taken along the line 4—4 in FIG. 2.

As is customary, the Geneva drive wheel 32 includes a driving pin 36 and a locking ring 38. The driven wheel of the Geneva mechanism is formed as part of the drive cam 40 which drives the drive pawl 20. The drive cam 40 is formed with stub shafts on both sides thereof which are journaled for rotation in suitable openings provided in the front plate 16 and the motor mounting plate 24. As shown in FIGS. 1 and 3, the drive cam 40 has a channel 42 formed in one face thereof. The channel 42 forms a closed path surrounding the center of rotation of the drive cam 40 and has a first, or inner, wall 44 and a second, or outer, wall 46. The inner wall 44 forms a first camming surface for the drive pawl 20 and the outer wall 46 forms a second camming surface for the drive pawl 20. The drive pawl 20 is formed with a pin 48 which extends transversely to the direction of reciprocation of the drive pawl 20, which direction of reciprocation is along the major longitudinal axis of the drive pawl 20. The pin 48 acts as a cam follower and is adapted to extend into the channel 42 between the walls 44 and 46. The drive pawl 20 is further formed with a tail section 50 which extends beyond the pin 48, the tail section 50 being of sufficient dimension so that it always spans the channel 42, irrespective of the rotative angle of the drive cam 40. This insures that an end of the drive pawl 20 does not get jammed against one of the walls 44,46. The drive pawl 20 is further formed with a guide pin 52 on the opposite side of the drive pawl 20 from the cam follower pin 48. The guide pin 52 cooperates with an elongated slot 54 formed in the front plate 16 and a depending tab 56 formed from the front plate material cut away when the slot 54 was formed to keep the drive pawl 20 reciprocating in a linear direction substantially major longitudinal axis. The size of the guide pin 52 in a direction transverse to the direction of reciprocation of the drive pawl 20 is substantially the same as the width of the slot 54. A leaf spring 58 held by depending tabs 60 and 62, which are formed from the front plate 16, yieldably biases the drive pawl 20 against the ratchet track 18. The leaf spring 58 is formed with two fingers 64 and 66, with the finger 64 yieldably biasing the drive pawl 20 against the ratchet track 18. The spring finger 66 biases the anti-reverse pawl 68 against the ratchet track 18.

The drive cam 40 has formed thereon as one layer thereof a driven wheel which cooperates with the Geneva drive wheel 32. This driven wheel includes a plurality of slots 70 which are intermittently engaged by the driving pin 36 to convert the continuous rotary motion of the wheel 32 into intermittent rotary motion of the drive cam 40. On the drive cam 40, the portion of the inner wall forming a camming surface for defining the drive stroke of the drive pawl 20 extends with increasing radius from the point A to the point B. This camming surface is included within a fixed angle of 360°/N around the axis of rotation of the drive cam 40, where N is an integer greater than 1. In particular, where a Geneva stepping mechanism is utilized as illustrated, the number N should be equal to the number of slots 70. Thus, as illustrated, there are five slots 70 which means that for each full rotation of the Geneva drive wheel 32, the drive cam 40 is rotated 72°. Therefore, the camming surface extending between the points A and B must subtend an angle no greater than 72°. Further, the location of that camming surface relative to the slots 70 must be such that during a single intermittent movement of the drive cam 40, the cam follower pin 48 traverses the entire camming surface between the points A and B to complete the drive stroke of the drive pawl 20 within a single intermittent movement. Thus, the switching time, which occurs during the drive stroke, has been shortened relative to the time between advancements. This has the same effect as if the slope of the camming surface were increased.

Figure 5:
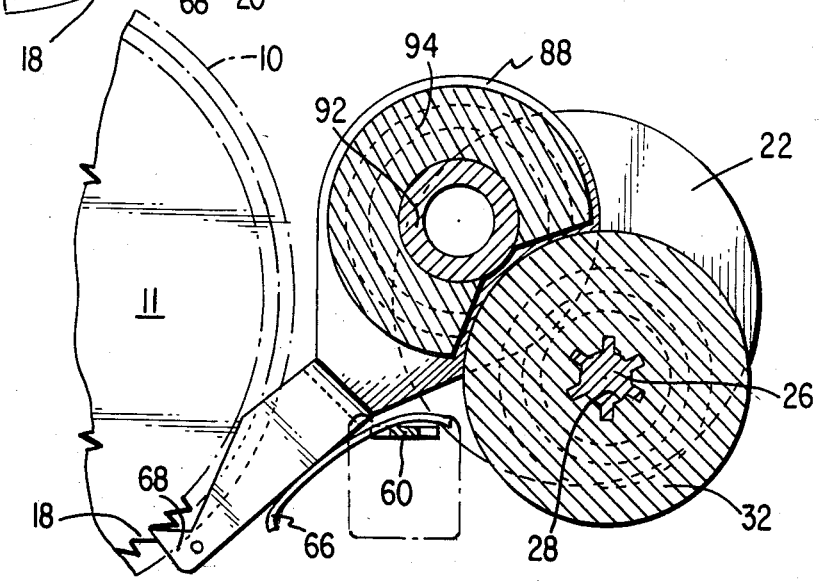
FIG. 5 is a cross sectional view taken along the line 5—5 in FIG. 2.

The anti-reverse pawl 68 is formed with an enlarged extension 88 having an opening 90 encircling the boss 92 of the drive cam 40. To complete the assembly, a spacer 94 also encircles the boss 92 between the anti-reverse pawl extension 88 and the Geneva driven wheel portion of the drive cam 40. The spacer 94 is almost circular, with a cutout portion to accommodate the Geneva drive wheel 32, as shown in FIG. 5.

In order to provide the function of sub-interval switching, the outer periphery of the drive cam 40 is formed with a sub-interval cam 72. (Alternatively, the sub-interval cam may be formed on the Geneva drive wheel 32). A sub-interval switching lever 74 is mounted for pivotal movement on a pivot stud 76 fastened as by staking to the front plate 16. The lever 74 has a cam follower end 78 riding on the sub-interval cam 72. The other end of the lever 74 forms a sub-interval switch actuator 80 which controls the movement of the sub-interval switch blade 82. Thus, when the follower end 78 is against a low portion of the cam 72, the switch blade 82 biases the actuator end 80 toward the ratchet track 18 and closes the switch with the contact blade 84. When the follower 78 is against a high part of the cam 72, the lever 80 acts against the biasing force of the blade 82 to open the switch. Movement of the lever 74 is limited by a tab 86 formed from the front plate 16.

Accordingly, there has been disclosed a fast impulse drive mechanism for a program timer. It is understood that the above-described embodiment is merely illustrative of the application of the principles of this invention. Numerous other embodiments may be devised by those skilled in the art without departing from the spirit and scope of this invention, as defined by the appended claims.

I claim:

1. A program timer of the type having a continuously driven motor, a plurality of timing cams mounted on a rotating member and controlling the operation of switches in a predetermined program, a ratchet track on the rotating member, and a drive pawl operatively associated with the ratchet track and the motor for advancing the rotating member in a step-by-step manner, characterized by:

a rotatable drive cam having a camming surface for defining the drive stroke of said drive pawl, said camming surface being included within a fixed angle of 360°/N around the axis of rotation of said drive cam, where N is an integer greater than 1;

a cam follower on said drive pawl cooperating with said camming surface; and drive means coupled between said motor and said drive cam for intermittently rotating said drive cam by said fixed angle, said drive means and said drive cam being so synchronized that all of said camming surface engages said cam follower during a single intermittent movement of said drive cam.

2. A program timer according to claim 1 further characterized in that said drive means includes a shaft coupled to said motor for continuous rotation therewith, a first gear mounted on said shaft for rotation therewith, and a second gear coupled to said first gear to move said drive cam.

3. A program timer according to claim 2 further characterized in that said first and second gears together form a Geneva mechanism.

4. A program timer according to claim 3 further characterized in that said first gear comprises a Geneva drive wheel including a drive pin and said second gear comprises a Geneva driven wheel having N slots engagable by said drive pin.

5. A program timer according to claim 4 further characterized in that said Geneva driven wheel is formed of one piece construction with said drive cam.

6. A program timer according to claim 1 further characterized by:

a sub-interval cam formed on said drive cam;

a sub-interval switch;

a sub-interval lever having a cam follower end and a switch actuator end; and means for mounting said lever for pivoting motion with said cam follower end cooperating with said sub-interval cam and said switch actuator end cooperating with said sub-interval switch so that said sub-interval switch is alternately opened and closed in accordance with the contour of said sub-interval cam as said drive cam is rotated.

7. A program timer according to claim 1 further characterized by:

a sub-interval cam rotated by said drive means;

a sub-interval switch;

a sub-interval lever having a cam follower end and a switch actuator end; and means for mounting said lever for pivoting motion with said cam follower end cooperating with said sub-interval cam and said switch actuator end cooperating with said sub-interval switch so that said sub-interval switch is alternately opened and closed in accordance with the contour of said sub-interval cam as said drive cam is rotated.

* * * * *